United States Patent [19]

Nakatsugawa

[11] Patent Number: 4,964,965

[45] Date of Patent: Oct. 23, 1990

[54] INSOLUBLE ELECTRODE DEVICE FOR TREATMENT OF METALLIC MATERIAL

[75] Inventor: Hiroshi Nakatsugawa, Yokohama, Japan

[73] Assignee: Furukawa Circuit Foil Co., Ltd., Tokyo, Japan

[21] Appl. No.: 465,516

[22] Filed: Jan. 16, 1990

Related U.S. Application Data

[63] Continuation of Ser. No. 249,833, Sep. 27, 1988, abandoned.

[30] Foreign Application Priority Data

Oct. 1, 1987 [JP] Japan ..... 62-245922
Oct. 1, 1987 [JP] Japan ..... 62-245923

[51] Int. Cl.[5] ..... C25D 17/10
[52] U.S. Cl. ..... 204/280; 204/206; 204/284
[58] Field of Search ..... 204/28, 198, 206, 279, 204/280, 263, 284

[56] References Cited

U.S. PATENT DOCUMENTS 4,183,799 1/1980 Sellito et al. ..... 204/206
4,274,939 6/1981 Bjäreklint ..... 204/257

FOREIGN PATENT DOCUMENTS 2381835 10/1978 France ..... 204/284
58-44759 10/1983 Japan .

*Primary Examiner*—John F. Niebling
*Assistant Examiner*—Kathryn Gorgos
*Attorney, Agent, or Firm*—Frishauf, Holtz, Goodman & Woodward

[57] ABSTRACT

An insoluble electrode device comprises a box having a plurality of faces, one of which is an open face. An outlet for discharging an electrolyte solution is provided on at least one of the other faces of the box, and a porous electrode plate is mounted on the open face of the box. A liquid flow control panel is mounted behind the porous electrode plate for the interior of the box, whereby a fresh and uniform liquid flow of an electrolyte solution is provided in the space between the electrodes, and whereby a high quality electrolytic surface treatment can be achieved.

17 Claims, 5 Drawing Sheets

INSOLUBLE ELECTRODE DEVICE FOR TREATMENT OF METALLIC MATERIAL

This application is a continuation, of application Ser. No. 07/249,833, filed Sept. 27, 1988 now abandoned.

BACKGROUND OF THE INVENTION

This invention relates to an insoluble electrode device which is used for electrolytically treating a surface of a metallic material such as a metal plate, a metal strip, a metal tape and a metal foil; more particularly to an insoluble electrode device of a novel structure which is used, for example, when a surface of a metal strip is continuously subjected to a cathodic surface treatment such as electroplating and electrolytic chromate treatment, or an anodic surface treatment such as anodizing, and capable of supplying a fresh electrolyte solution constantly as a substantially uniform liquid flow to a space defined between the metal strip to be treated and the insoluble electrode as a counter electrode, whereby to enable high quality surface treatment of the metal strip. This invention particularly relates to an insoluble electrode device of a novel structure which can supply a fresh electrolyte solution constantly throughout the space between the electrodes which is defined by the metal strip to be treated and the insoluble electrode device as a counter electrode, and also can control the liquid flow of the electrolyte solution flowing through said space between the electrodes to minimize nonuniformity in the liquid flow of the electrolyte solution, whereby high quality surface treatment of the metal strip to be treated can be achieved.

When a metal strip is subjected to a surface treatment such as electroplating, for example, an anode is disposed to oppose a part of the metal strip immersed in an electrolyte solution, and the metal strip is weaved through the electrolyte solution to effect electrolytic treatment using the metal strip as a cathode.

An embodiment of the prior art will be described referring to the schematic drawing shown in FIG. 7. In FIG. 7, the numeral 1 shows a processing tank which is filled with a predetermined electrolyte solution 2. The numeral 3 shows a metal strip to be subjected to surface treatment, which is fed from outside of the tank into the electrolyte solution and runs through the electrolyte solution in the direction shown with an arrow P or in the opposite direction. The numerals **3*a* and 3*b* each show a guide roller, and 4** shows an anode which is disposed to oppose the part of the metal strip immersed in the electrolyte solution with a predetermined space there between.

Anodes of various shapes and materials have been proposed and can be exemplified by an insoluble electrode comprising a mesh or mesh plate, a perforated plate or a simple flat plate made of an insoluble metal, such as titanium, niobium and tantalum, having a coating of an active substance such as platinum or iridium oxide on the surface. An embodiment of such an insoluble electrode is shown in FIG. 8 by a perspective view. In FIG. 8, **4*a* shows a mesh composed of an insoluble metal and an active substance. FIG. 9 also shows another embodiment of a mesh electrode plate, by a side view, having a frame 4*b* surrounding the mesh electrode plate as shown in FIG. 8 for retaining the shape thereof and further a bus bar 4*c*** on the back for achieving uniform power supply.

In such as electrolytic treatment, an effort has been made to bring the metal strip to be treated into constant contact with a fresh electrolyte solution, by supplying continuously the electrolyte solution into a processing tank and discharging continuously the solution from the tank. For example, there have been adopted various systems such as a system where there is provided, at the lower portion of a processing tank, a means for supplying an electrolyte solution (not shown in the drawing) from which means an electrolyte solution is supplied into the space between the electrodes and there is provided, at the upper portion of the tank, a means for discharging the solution (not shown either) from which the electrolyte solution is discharged, and a system where, in contrast to the above-mentioned system, a means for supplying the electrolyte solution is provided at the upper portion of the processing tank and a means for discharging the electrolyte solution at the lower portion of the tank. These prior art methods are to supply uniform and regular flow of a fresh electrolyte solution constantly or continuously over the whole space between the electrodes.

However, when electrolytic treatment is conducted using such a device as shown in FIG. 7, the electrolyte solution present in the space between the electrodes defined by the anode 4 and the metal strip 3 is either in a static state or in a state of natural convection or floating with the supply or discharge of the electrolyte solution to or from the tank, and there are irregularity and nonuniformity in the liquid flow of the electrolyte solution flowing through the space between the electrodes.

Therefore, the state of contact between the surface of the metal strip 3 to be surface-treated and the electrolyte solution cannot be said to be uniform over the whole surface to be treated. Accordingly, it cannot be said that the surface treatment of the metal strip 3 is carried on in a uniform state over the whole surface to be treated.

For such reasons, a measure has been taken to force the electrolyte solution in the space between the electrodes to be stirred or a fresh electrolyte solution to be supplied from the top or the bottom to this space to bring a fresh electrolyte solution into contact with the metal strip over the whole surface to be treated as completely as possible.

Nevertheless, the electrolyte solution to be brought into contact with the metal strip 3 remains as turbulence to show nonuniform liquid flow even if such measure has been taken, and thus it cannot be said that the surface treatment of the metal strip 3 can be carried out in a completely uniform state.

SUMMARY OF THE INVENTION

This invention is directed to provide an insoluble electrode device of a novel structure which has overcome the problems as described above and can form a fresh and substantially uniform liquid flow of an electrolyte solution in the space between the electrodes, to enable high quality surface treatment compared with those to be obtained using any conventional device.

DETAILED DESCRIPTION

The insoluble electrode device of this invention is characterized by an electrode plate having apertures and attached to an open face of a box having on one side said open face and on at least one of other sides thereof an electrolyte solution discharge port.

PREFERRED EMBODIMENT OF THE INVENTION

Figure 1:
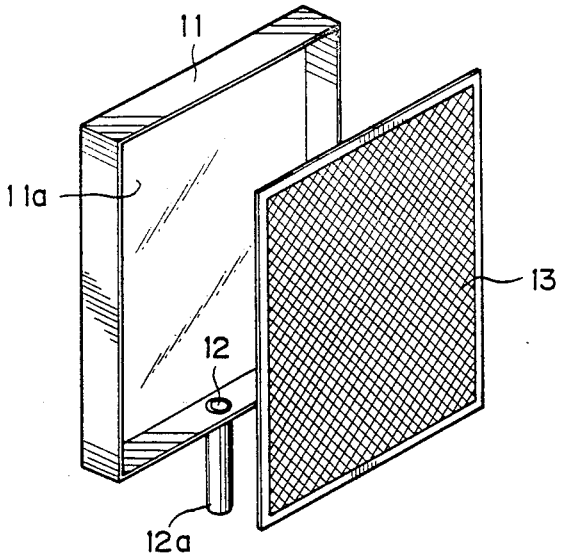
FIG. 1 is a perspective view, showing an embodiment of the disassembled insoluble electrode device of this invention.

The electrode device of this invention will be described in more detail referring to the perspective view illustrated in FIG. 1 showing the disassembled device.

In FIG. 1, 11 shows a box assembled with a liquid-impermeable material and having an opening on one face to form an open face 11*a*, and 12 shows at least one electrolyte solution discharge port formed in the box 11, which can be formed on any face except for the open face 11*a*. FIG. 1 illustrates a state where one discharge port (outlet) is formed on the bottom face of the box 11, and an electrolyte solution discharge pipe 12*a* is attached to this discharge port 12.

Figure 3:
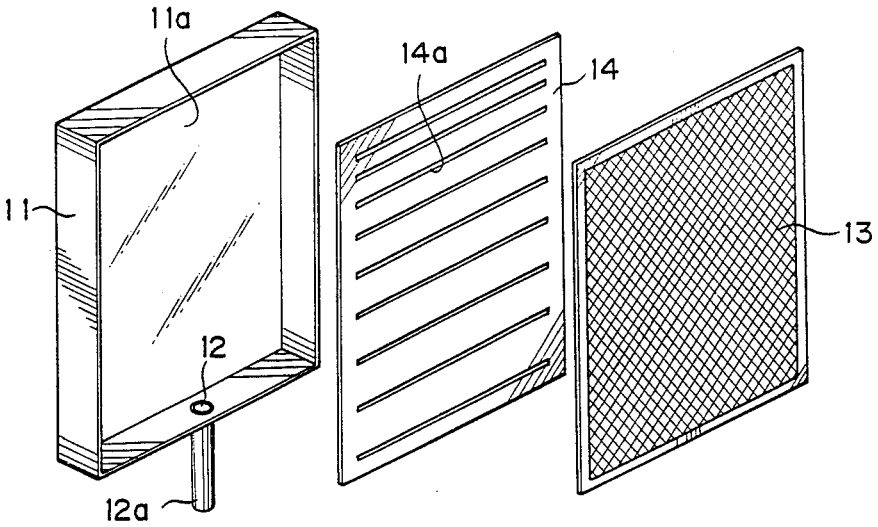
FIG. 3 is a perspective view, showing a preferred embodiment of the disassembled electrode device of this invention having a liquid flow control panel.

The numeral 13 shows an electrode plate having apertures such as a mesh plate and a perforated plate, which is attached to the box 11 such that it may entirely cover the open face 11*a* of the box 11 to form an integral structure. The mesh electrode plate 13 may be, for example, a perforated sheet form electrode plate in which a number of through holes having a predetermined shape are distributed, as well as the mesh electrode plate as illustrated in FIG. 3. In short, the mesh electrode plate 13 may be any plate type electrode so long as an electrolyte solution can permeate or flow therethrough from one face to another face.

Thus, the electrode device of this invention is constituted as a box comprising only one face made of a liquid permeable plate (such as a mesh plate and a perforated plate) and the other faces having no liquid permeability.

The electrode device of this invention is used as described below. To describe in detail referring to the drawing shown in FIG. 2, this electrode device is disposed in a processing tank 1 such that the mesh electrode plate 13 may oppose a metal strip 3 which runs through an electrolyte solution 2 filling the processing tank 1 in the direction shown with the arrow P or in the opposite direction with a predetermined space therebetween. The other end of the electrolyte solution discharge pipe 12*a* is drawn out to the exterior of the tank. In this state, for example, a fresh electrolyte solution is continuously supplied into the space between the electrodes and the electrolyte solution discharge pipe 12*a* may be connected to a suction device such as a discharging pump to effect electrolytic treatment. The discharge pipe 12*a* may simply be connected, without use of any suction pump, to an outer reservoir tank for discharged solution. In this case, the discharge may be carried out with the aid of gravity.

The electrolyte solution supplied to the tank flows into the box through the aperture portion of the mesh electrode plate 13 by the action of a suction device or gravity and is discharged through the discharge pipe 12*a*, wherein the liquid flow of the electrolyte solution supplied is formed into a relatively regular one in the course of flowing from the point of supply to the discharge pipe.

Accordingly, the metal strip 3 running in the tank regularly at a predetermined speed can constantly be brought into contact with a relatively regular and substantially uniform liquid flow of the electrolyte solution, whereby a high quality surface treatment can be achieved compared with those to be obtained by use of any convent anal electrode.

Figure 2:
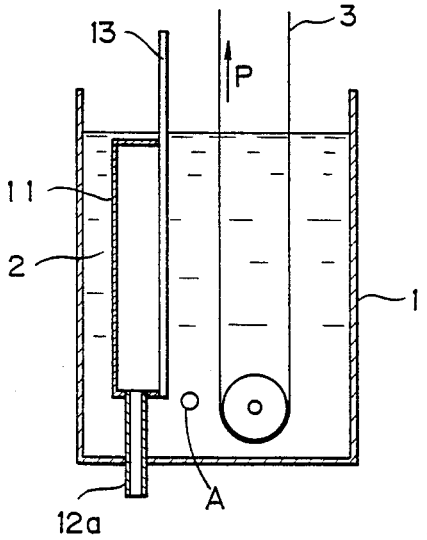
FIG. 2 shows schematically an example of the electrode device in use of this invention.

In FIG. 2, the upper part of the box may be out of the electrolyte solution, i.e., the upper wall of the box may be over the surface of the solution. In this case, the upper wall may be deleted.

A preferred insoluble electrode device of this invention comprises a box having an opening on one face and an electrolyte solution discharge pipe on at least one of other faces, mounted to the open face thereof, an electrolyte solution liquid flow control panel for controlling flow of the electrolyte solution and an electrode plate having apertures such as mesh, holes and so on, in this order.

The liquid flow control panel is used for the purpose of making the flow at the space between the electrodes more uniform over the whole space region.

The preferred electrode device of this invention will be described in more detail referring to the perspective view illustrated in FIG. 3.

In FIG. 3, 11 shows a box comprising a liquid-impermeable material and having an opening on one face to form an open face 11*a*; and 12 shows at least one electrolyte solution discharge port formed in the box 11, which can be formed in any face except for the open face 11*a*. FIG. 3 illustrates a state where one discharge port 12 is formed on the bottom face of the box 11, and an electrolyte solution discharge pipe 12*a* is connected to this discharge port 12.

The numeral 13 shows an electrode plate having apertures such as pores, holes, slits, gaps, mesh and so on, and can be, for example, a mesh sheet form electrode plate in which a number of through holes or mesh holes having a predetermined shape are distributed, as illustrated in FIG. 3.

The numeral 14 shows a liquid flow control panel which is interposed between the open face 11*a* of the box and the above mesh electrode plate 13.

This liquid flow control panel comprises a plate on which a plurality of apertures or holes are formed from one end to the other end, wherein these apertures or holes are formed such that the apertures or holes on one end portion have a higher rate of opening than those on the other end portion. The expression "rate of opening" used herein is defined as a product of the number of apertures, formed in any one section to be obtained when the plate is equally divided into some sections from one end to the other end of the liquid flow control panel, and the area of the apertures or the holes. In other words, the expression "rate of opening" used herein is defined as a rate of area for opening against the relevant surface area in question of the liquid control panel.

FIG. 3 illustrates an embodiment where the opening portions comprise slits 14*a*, in which slits 14*a* are sparsely distributed in the lower area of the panel with a wider space between the slits; whereas in the upper area of the panel they are densely dispersed with a narrower space between the slits. Further, it is possible to form the slits in the lower area to have a smaller width; and those in the upper area to have a larger width. Accordingly, the slits formed in the upper part of the panel have a higher rate of opening and those formed in the lower part have a lower rate of opening.

Figure 4:
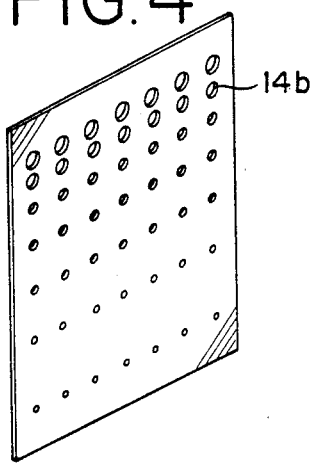
FIGS. 4 and 5 each show another embodiment of a liquid flow control panel to be attached to the insoluble electrode device of this invention.

FIG. 4 shows an embodiment where the apertures comprise circular holes distributed throughout the panel, in which smaller diameter holes are sparsely distributed in the lower part of the panel; whereas larger diameter holes are densely distributed in the upper part of the panel. It should be noted that the holes may not be limited to the circular holes and can take any shape such as elliptical holes or various rectangular holes.

Figure 5:
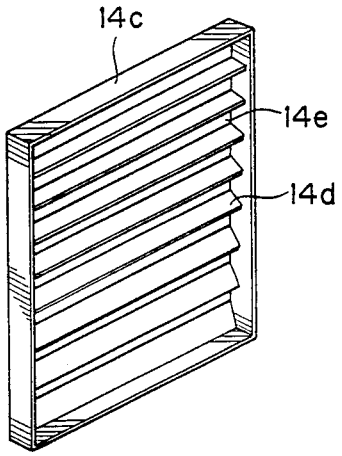

The liquid flow control panel shown in FIG. 5 illustrates a structure, comprising a frame 14*c* having a profile which is equal to that of the open face 11*a* of the box and having a plurality of louvers 14*d* extended between both sides of the frame 14*c*. In this embodiment, spaces 14*e* defined between the louvers 14*d* serve as the holes. In the embodiment having such structure, by adjusting the gradient angle of the louvers 14*d*, i.e., for example, by allowing the louvers 14*d* located in the lower part of the Figure to have a larger gradient angle, and allowing the louvers to have smaller angles toward the upper part of the Figure, it can be designed that the higher the aperture is located in terms of the Figure, the higher may be the rate of opening.

In such a liquid flow control panel, it is necessary to vary the shape and size of the apertures or the holes to be formed on the panel, state of distribution, rate of opening, etc. depending on various conditions for surface-treating a material to be treated, for example, dimensions or shape of the material to be treated, electrolytic conditions and liquid permeability of the perforated or mesh electrode plate. Accordingly, they cannot be determined indiscriminatingly. More delicately, fine adjustment can be achieved by varying the size or arrangement of the apertures or the holes, for example, between those formed in the right side of the panel from those formed in the left side depending on the position where the electrolyte solution discharge pipe 12*a* is mounted. In short, the size of the apertures or the holes in the liquid flow control panel and the way of their distribution can be varied so that the electrolyte solution may flow through the space between the electrodes uniformly.

Figure 6:
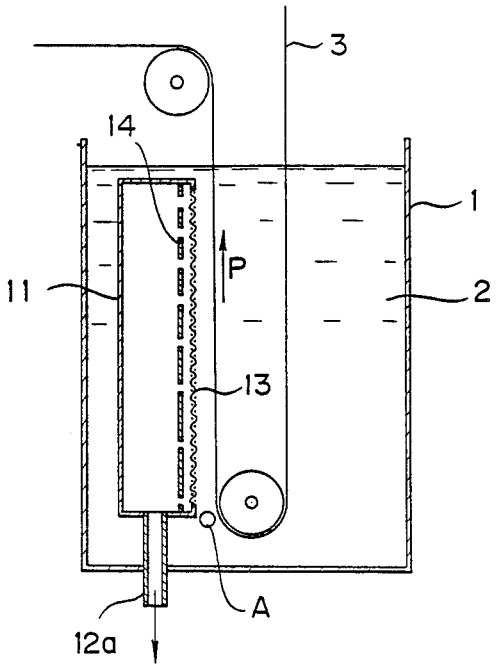
FIG. 6 shows schematically a state where a preferred insoluble electrode device (having a liquid flow control panel) of this invention is in use.
Figure 7:
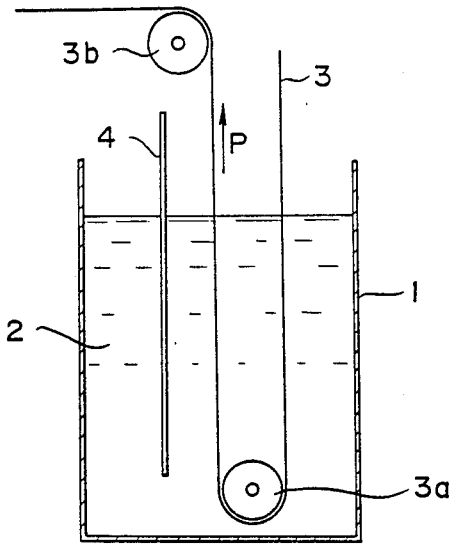
FIG. 7 (PRIOR ART)
FIG. 7 shows schematically a state where a conventional electrode is in use.
Figure 8:
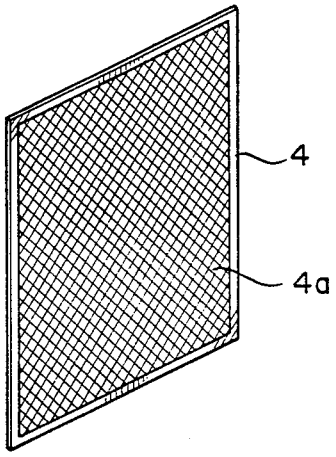
FIG. 8 (PRIOR ART)
FIG. 8 shows schematically an embodiment of a conventional electrode.
Figure 9:
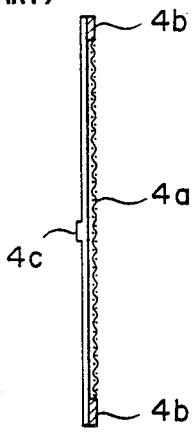
FIG. 9 (PRIOR ART)
FIG. 9 shows schematically a side view of another embodiment of a conventional electrode.

A preferred embodiment of the electrode device of this invention is used in the following manner. The state of the electrode device in use is schematically illustrated in FIG. 6. In FIG. 6, 1 shows a processing tank, 2 an electrolyte solution filling the processing tank, and 3 a metal strip running in the direction shown with the arrow P or in the opposite direction.

The electrode device of this invention illustrated in FIG. 3 is disposed such that the metal strip 3 and the perforated or mesh electrode plate 13 may oppose to each other with a predetermined space. In FIG. 6, the liquid flow control panel 14 to be interposed between the box 11 and the perforated or mesh electrode plate 13 has been attached such that the end portion having a smaller rate of opening may be disposed at the bottom. A fresh electrolyte solution is supplied from the lower point A in the space between the electrodes, whereas the electrolyte solution discharge pipe 12*a* attached to the bottom face of the box 11 is, for example, connected to a suction device such as a discharging pump to discharge the electrolyte solution therethrough.

In this state, while the liquid permeability of the perforated or mesh electrode plate is substantially uniform over the entire surface thereof, the liquid flow control panel 14 to be disposed behind the electrode plate has a higher rate of opening in the upper portion and a lower rate of opening in the lower portion, whereby to provide a condition where the electrolyte solution flows easily in the upper part of the space between the electrode, and it flows less easily in the lower part thereof. Therefore, the electrolyte solution supplied from the feed opening A does not flow into the lower part of the device in any significant amount but flows directly upward to provide a condition where the electrolyte solution can flow more uniformly, whereby the problem that the electrolyte solution supplied flows taking a short cut without flowing upward to reach the upper portion due to the arrangement that the feed opening A and the electrolyte solution discharge pipe 12*a* are disposed close to each other, which might be caused when the liquid flow control panel is not employed can be solved. Namely, the inclination that the electrolyte solution flows taking a short cut from the feed opening A to the electrolyte solution discharge pipe 12*a* since they are disposed close to each other is offset by the inclination that the electrolyte solution is allowed to flow upward easily by the action of the liquid flow control panel, whereby a sufficient amount of liquid flow can be secured for flowing into the box after the electrolyte solution has reached the upper portion of the space. Thus, a sufficient amount of fresh electrolyte solution can flow from the feed opening A provided at a lower part throughout the space between the electrodes even to the apertures which is spaced farthest from the feed opening A.

Incidentally, while FIG. 6 shows an embodiment in which the feed opening A is provided at a lower position, the feed opening A may be provided at an upper position. In the latter embodiment, contrary to the embodiment shown in FIG. 6, the liquid flow control panel can be attached to the box upside down, i.e., the portion having a lower rate of opening may be located at the top.

In the electrode device of this invention, while the embodiment of attaching the liquid flow control panel may depend on the arrangement of the feed opening and the discharge port, it is usually attached so that the portion of the liquid flow control panel having a lower rate of opening may be disposed adjacent to the feed opening for the electrolyte solution.

Figure 10:
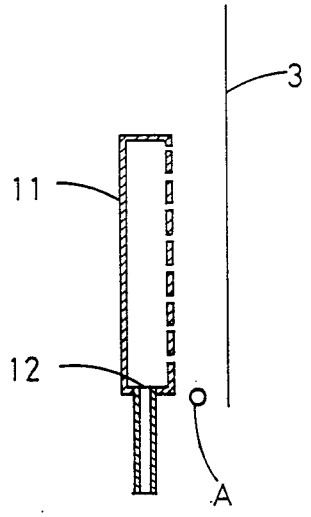
FIG. 10 shows schematically an embodiment of the device of the present invention, in which the discharge port 12 is located on the same side as in the liquid feed inlet (opening) A.

In cases where the liquid feed inlet (opening) A is on the same side of the discharge port 12 (see FIG. 10), in order to make uniform the flow of the liquid flowing into the electrode box, it is natural that the opening rate of the control panel should be made smaller in the vicinity of the feed inlet A and the discharge port.

Figure 11:
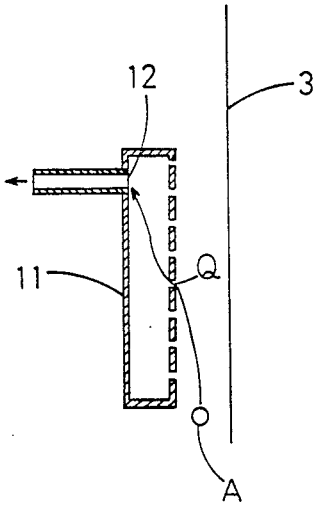
FIG. 11 shows schematically an embodiment of the device of the present invention, in which the discharge port 12 is located on the opposite side to the liquid feed inlet (opening) A.
Figure 12:
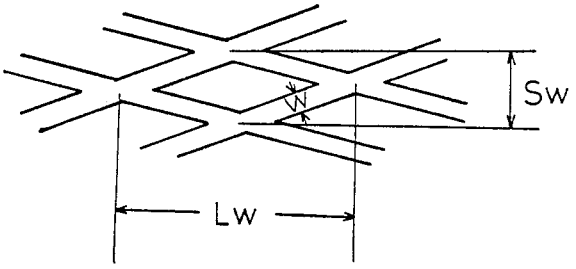
FIG. 12 shows the shape of the lath as used in Example 1 in which it is represented by t1×Lw6×Sw3.2×w2.

In cases where A and 12 are in the opposite side with each other (e.g., top and bottom, or bottom and top) (see FIG. 11), the oblique course of flow as seen in FIG. 11 is the most natural flow. Therefore, the opening rate should be minimized at the portion Q of the control panel.

Specific course of the flow may change depending also on the distance between 13 and 3 and on the relationship of the depth of 11 with them. Therefore, it results that each width of the plate or board at 14 of FIG. 3 and the width of the opening 14*a* are determined eventually by the method of trial-and-error.

As can be clearly seen from the above description, the electrode device of this invention can form a constant and substantially uniform liquid flow of fresh electrolyte solution in the vicinity of the surface of a metal strip to be treated running therethrough. Accordingly, high quality surface treatment of the metal strip can be achieved compared with those obtained using any conventional electrode.

Further, electrolytic gas to be generated on the surface of the electrode plate of the present device can be sucked into the box and removed efficiently at any place throughout the plate, whereby the state of nonuniform current distribution which may be caused due to floating of such gas in the space between the electrodes or reduction in the quality of the treated surface which may be induced when such gas reaches the surface of the material to be treated can be obviated.

The device of this invention has been described referring to continuous electroplating of a metal strip running in the tank. However, the electrode device of this invention may not be limited thereto, and is useful when employed for the treatment with electrolytic chromate treatment or anodizing. Further, if the device of this invention is used for electroplating a metal flat plate, inconveniences such as uneven thickness in the deposit depending on the portions or reduction in the quality of the deposit can be solved effectively.

The present invention will be explained in more detail by way of the following Examples and Comparison.

EXAMPLE 1

In an apparatus as shown in FIG. 2, two anode boxes were placed on the left side of the metal foil running out of the electrolyte solution and the right side of the metal foil coming into the solution, respectively. The working surface of the anode box, i.e., 13 in FIG. 1, had been prepared by coating iridium oxide ($I_rO_2$) on the front face of expansion metal of $T_i$ (titanium). The width of the working surface was 500 mm; the height thereof was 600 mm; and the shape of the lath was represented by $t1 \times Lw6 \times Sw3.2 \times w2$. The thickness of the $I_rO_2$ coating corresponded to 30 g/m$^2$ substantial surface area. The thickness of the box was 90 mm. The metal foil surface is a rough surface of an electrolytic copper foil having a thickness of 35$\mu$ and ran at a speed of 3.3 m/min. through the electrolyte solution. The solution was composed of 35 g/l of $Cu^{2+}$ and 100 g/l of $H_2SO_4$. The temperature of the electrolyte solution was 27° C. and the amount of the solution flowing into each of the anode boxes was 10 l/min. The distance between the surface of the copper foil and the working surface of the anode box was 40 mm. The electric current between each of the anode boxes and the copper foil was 18 A/dm$^2$.

As the result, uniform nodularized surface was obtained continuously.

COMPARISON 1

As a comparison, an experiment was carried out in the same manner as in Example 1 except that a flat plate anode having the same area was used in place of the anode box according to the present invention. As the result, no uniform treated surface was obtained.

EXAMPLE 2

In an apparatus as shown in FIG. 6, the working surface of the anode box was made 350 mm wide and 1000 mm high and a control panel as indicated by numeral 14 in FIG. 3 was installed. In the control panel, the widths of the slits 14*a* were all 5 mm; and the widths of the eight(8) transverse plates were, from the top to the bottom, 50, 70, 90, 110, 130, 150, 170 and 190 mm. By using this anode box, a continuous electrolytic treatment was conducted in the same manner as in Example 1 except that the liquid flow rate was made to be around 20 l/min. As the result, uniform nodularized surface was obtained.

In cases where there was not installed any control panel, it was found that gas was going up between the electrodes at the upper portions of both electrodes and that the liquid took a short cut at the lower portion of the lath 13.

What is claimed is:

1. An insoluble electrode device for use in electrolytic treatment of a surface of a metallic material, comprising:

a box having a plurality of faces, one of said faces being an open face;

an outlet for discharging electrolyte solution on at least one of the other faces of said box;

a porous electrode plate mounted substantially vertically to said open face of said box; and a liquid flow control panel mounted substantially vertically behind said porous electrode plate toward the interior of said box;

said liquid flow control panel having upper and lower ends;

a plurality of liquid permeable holes distributed throughout said liquid flow control panel from one of said upper and lower ends to another of said upper and lower ends, the rate of opening of said holes increasing from said lower end toward said upper end, such that the bottom portion of said liquid flow control panel adjacent said lower end has the smallest opening areas of said holes per unit area of said liquid flow control panel, and the upper portion of said liquid flow control panel has the largest opening areas of said holes per unit area of said liquid flow control panel; and said electrolyte solution discharge port and an electrolyte solution feed opening being disposed on the same side of said liquid flow control panel.

2. The insoluble electrode device of claim 1, wherein said holes in said liquid flow control plate are slits formed in the horizontal or transverse direction.

3. The insoluble electrode device of claim 1, wherein said holes in said liquid control plate comprise circular holes.

4. The insoluble electrode device of claim 1, wherein said liquid flow control plate has louvers formed therein, and wherein said louvers comprise said holes in said liquid flow control panel.

5. The insoluble electrode device of claim 1, wherein said electrolyte solution discharge port and said electrolyte solution feed opening are disposed at either end of said liquid flow control panel.

6. The insoluble electrode device of claim 1, wherein said holes in said liquid flow control panel comprise ellipse holes.

7. The insoluble electrode device of claim 1, wherein said holes in said liquid flow control panel comprise rectangular holes.

8. An insoluble electrode device for use in electrolytic treatment of a surface of a metallic material, comprising:

a box which is submerged in a process tank having an electrolyte solution therein, said box having a plurality of faces, one of said faces being an open face, said open face being disposed such that the metallic material which is moving in a predetermined direction in said tank whenever the metallic material is being treated and said open face are opposed to each other with a predetermined spacing therebetween;

an outlet for discharging electrolyte solution, the outlet being on at least one of the other faces of said box;

a porous electrode plate mounted to said open face of said box; and a liquid flow control panel mounted behind said porous electrode plate toward the interior of said box.

9. The insoluble electrode device of claim 8, wherein said liquid flow control panel has holes therein, and said holes in said liquid flow control panel are slits formed in the horizontal or transverse direction.

10. The insoluble electrode device of claim 8, wherein said liquid flow control panel has holes therein, and said holes in said liquid flow control panel comprises at least one of circular holes, ellipse holes and rectangular holes.

11. The insoluble electrode device of claim 8, wherein said liquid flow control panel has louvers formed therein, and wherein said louvers comprise holes in said liquid flow control panel.

12. The insoluble electrode device of claim 8, wherein:

said liquid flow control panel has upper and lower ends;

a plurality of liquid permeable holes are arranged in said liquid flow control panel from one of said upper and lower ends to another of said upper and lower ends;

the rate of opening of said holes increases from said one end toward said another end; and said electrolyte solution discharge port and an electrolyte solution feed opening are disposed on the same side at either end of said liquid flow control panel.

13. The insoluble electrode device of claim 12, wherein said rate of opening of said holes increases from said lower end toward said upper end.

14. The insoluble electrode device of claim 12, wherein said holes in said liquid flow control panel are slits formed in the horizontal or transverse direction.

15. The insoluble electrode device of claim 12, wherein said holes in said liquid flow control panel comprises at least one of circular holes, ellipse holes and rectangular holes.

16. The insoluble electrode device of claim 12, wherein said liquid flow control panel has louvers formed therein, and wherein said holes comprise said louvers.

17. The insoluble electrode device of claim 8, wherein said electrolyte solution discharge port and an electrolyte solution feed opening are disposed on the same side at either end of said liquid flow control panel.

* * * * *